United States Patent [19]

Ditcher

[11] 4,088,361

[45] May 9, 1978

[54] LIFTING ARRANGEMENTS FOR MASSIVE OBJECTS

[75] Inventor: John Ditcher, Langhorne, Pa.

[73] Assignee: A-Lok Corporation, Trenton, N.J.

[21] Appl. No.: 730,007

[22] Filed: Oct. 6, 1976

[51] Int. Cl.[2] ..... B66C 1/66

[52] U.S. Cl. ..... 294/89; 52/707; 294/82 R

[58] Field of Search ..... 294/89, 86 R, 82, 78; 52/125, 698, 699, 700, 701, 702, 703, 704, 706, 707, 708, 709, 711; 403/330

[56] References Cited

U.S. PATENT DOCUMENTS

| | | | |
|---|---|---|---|
| 3,628,820 | 12/1971 | Blatt | 294/89 |
| 4,018,470 | 4/1977 | Tye | 52/707 |

*Primary Examiner*—James B. Marbert
*Attorney, Agent, or Firm*—Andrew R. Klein

[57] ABSTRACT

Pockets, defined by molded plastic shells, are embedded in a massive concrete article. Lifting cables have rods to fit into the pockets. The shells which define these pockets are injection-molded to provide a lateral spline to pass a key formed on the lifting rod, and also have a parti-cylindrical end housing, closed by a snap-fitted cover plate, within which housing the key rotates to lock the rod in the socket when lift is applied to the rod.

6 Claims, 6 Drawing Figures

Fig. 1.
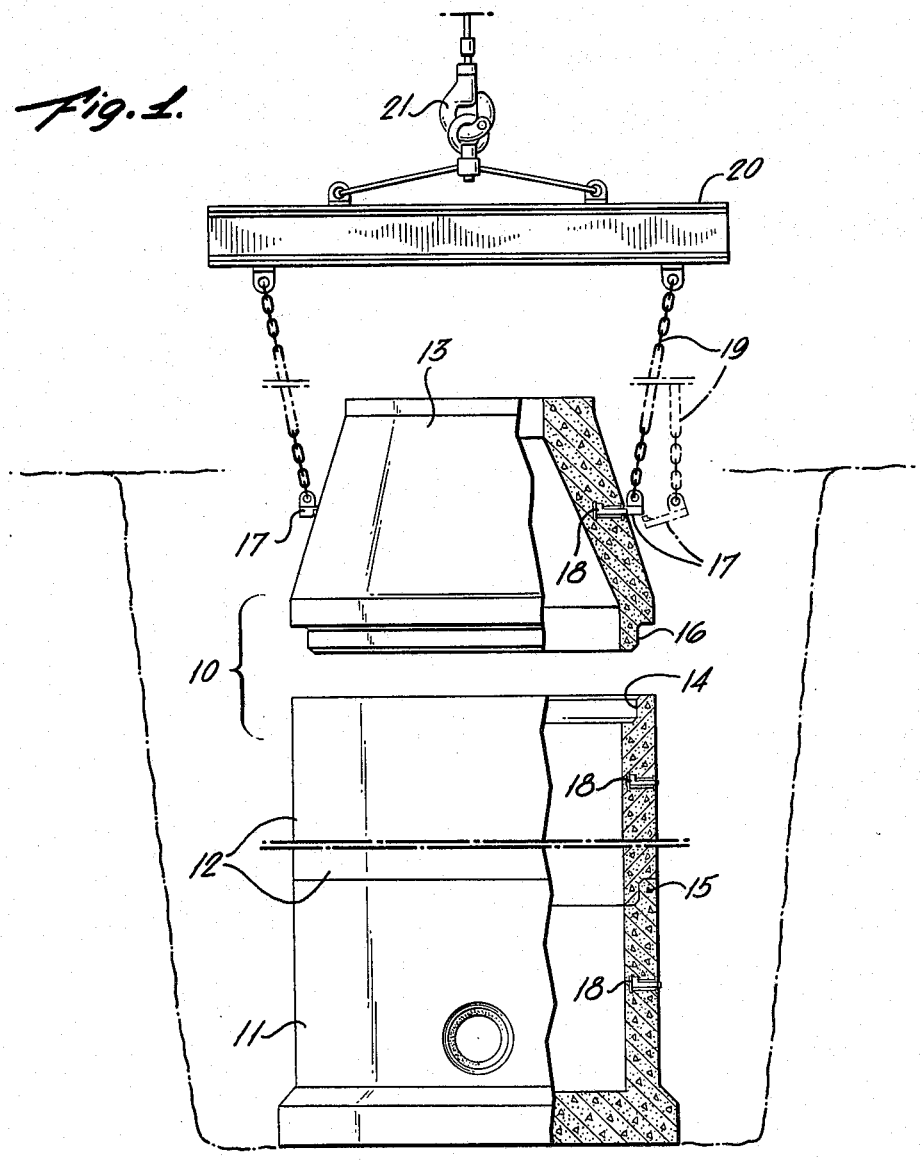
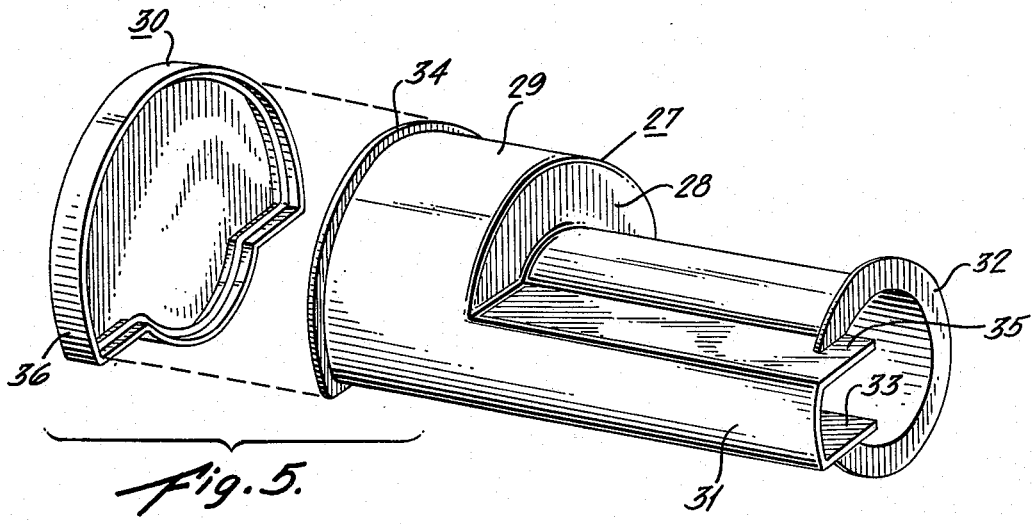
Fig. 5.

LIFTING ARRANGEMENTS FOR MASSIVE OBJECTS

This invention relates to massive concrete objects and devices for lifting them. More particularly, it has to do with the construction of manholes for underground lines, especially sewers, and it is specifically concerned with the erection of manhole structures by the use of precast sections, laid up one above the other. It involves the provision of lifting sockets formed by embedding inexpensive shells or molds in the walls of the sectional units as these units are poured or cast. These shells remain in the finished section as and after it is cured. They are configured to coact with lifting rods or pins which are inserted in the shells in the cured sections prior to hoisting these sections into place. The lifting rods are subsequently removed for repeated use.

It has long been known to drill aligned holes horizontally into two opposite walls of extremely heavy concrete sections (hereinafter termed "castings"), and to insert the shank of an eye-bolt into each hole. A tension member (cable or chain) is attached to the eye of each bolt, outboard of the casting, and the tension members are lifted simultaneously, as by means of a spreader bar and a crane, for example, thereby hoisting the casting. The holes must, of course, be approximately aligned with the transverse center of gravity or there is danger that the suspended casting may tilt so far as to interfere with the quick and accurate placement of it.

Unfortunately, it sometimes happens that the casting, while being swung into place, bumps into something, or is otherwise jolted out of its intended horizontal position. When this occurs, one of the supporting eye-bolts may pull out of the hole which held it, and permit the casting to drop, with great risk of injury to workmen in the excavation in which the manhole structure is being built. In addition to the very serious risk of injury to personnel is the likelihood that the dropped casting will be severely damaged or will severely damage a casting previously emplaced.

Various proposals have been offered to overcome this problem, but the only one which seems to have practical promise is one in which the lifting eye-bolts are provided with terminal lugs or keys at their inner ends, which are received in sockets defined by mold forms which are embedded in the concrete as it is cast, and are subsequently withdrawn slightly, into fitted nests. The molds are so shaped as to provide longitudinal key-ways or splines to pass the keyed end of the bolt, and with arcuate chambers at the inner end in which the keys may rotate into locking position. They also have lateral projections at 90° from the channels, forming nests to receive the partially withdrawn keys.

Such a mold form, having dual pockets at its inner end, and an eye-bolt having dual keys at its contact point require the use of complex molds, which are fairly costly to make and also are bulky, and not as rugged as would be desirable. They sometimes are troublesome to use, because the keys have to be quite accurately fitted into them and their associated pockets by the sense of touch.

The primary objectives of this invention are to provide a lifting rod which will normally engage the lifting cable outboard of the casting, which rod will have a single key at one end adapted for rotation through a one-quarter turn, while at the same time providing a shell for the socket, preferably of plastic material, which can be inexpensively produced and will be free of any interior roughness which might interfere with ready use, and which does not require sensitive interfitting. The assembled key and socket afford a temporary interconnection between key and casting which ensures that the key will remain in a position to engage the socket so long as there is load upon the line, no matter how the casting may tilt, thus greatly reducing the risk of dropped castings, with the attendant risk of injury to personnel or parts.

How these and other objectives which will occur to those skilled in the art are to be achieved will be clear from the description which follows and from the accompanying drawings, which illustrate a preferred form of the invention, and in which:

FIG. 1 is an elevational view, partly in section, of a typical form of manhole, modified in accordance with this invention, the upper casting being illustrated as about to be laid in place;

FIG. 5 is a perspective view of the mold used in forming the socket of FIG. 2.

Figure 2:
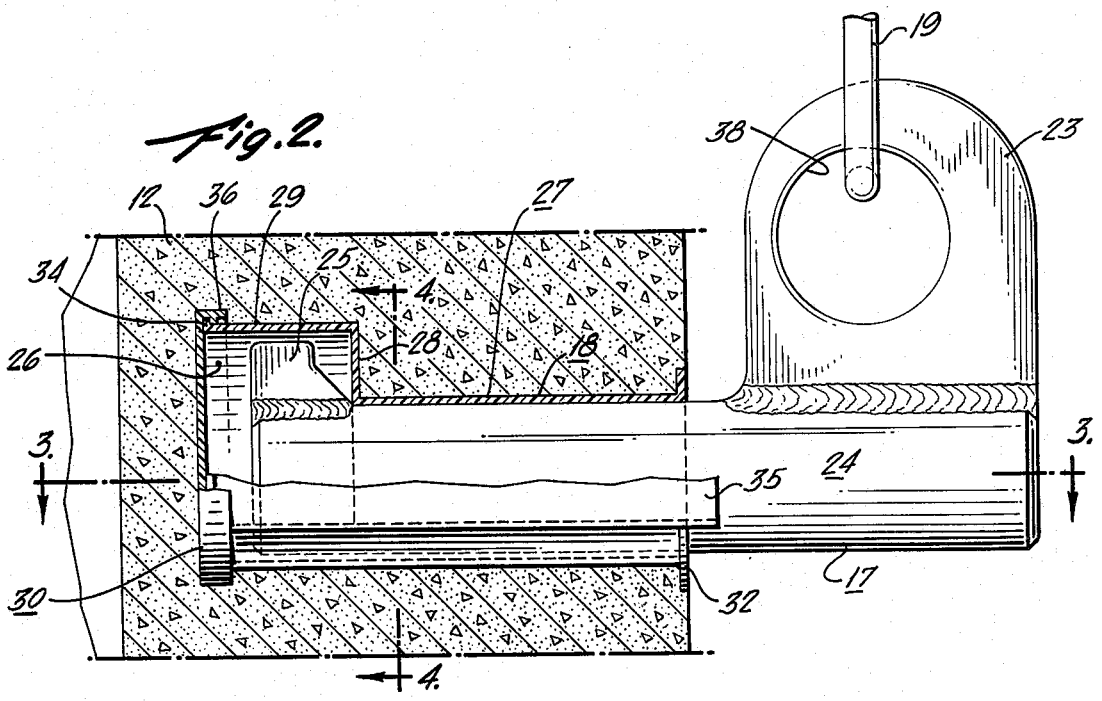
FIG. 2 is a sectional view, on a greatly enlarged scale, partly in elevation, of a socket made according to this invention, with a lifting rod resting therein.

Turning now to FIG. 1: The manhole 10 comprises a base section 11, a riser 12, and an eccentric upper cone 13. The single riser 12 illustrated is shown in broken-away form to suggest that its height is greater than illustrated. Additional risers may be used if the manhole is deep. The riser 12 is oppositely rabbeted about its upper rim 14 and lower rim 15, so that it fits correspondingly rabbeted rims in the mating upper rim of the bottom section 11 and the lower rim 16 of the upper cone 13, so that the sections fit together by way of ship-lap joints. This is standard construction in this field. The lift rods 17, 17 of the present invention are illustrated in the sockets 18, 18 formed in the casting, in this case, in the riser 12. The lift rods 17, 17 are attached to hoisting chains or cables 19 (only one is here illustrated) which depend from opposite ends of a spreader bar 29 hung from the hook 21 of the crane.

The heart of the new arrangement which I propose is shown on an enlarged scale in FIG. 2. The hoisting chain 19 engages the outer portion 22 of an apertured ear 23, which projects laterally from the outside portion 24 of the rod 17 and is integral therewith. At its opposite end the rod 17 carries a lug or key 25 which projects laterally from the rod in the same plane as the ear 23, but extends radially outward from the rod a considerably shorter distance than the ear 23. The key 25 and most of the rod 17 are enclosed within the cavity 26 which is provided within the shell 27, the latter being tubular in form and just enough larger in diameter than the rod 17 to provide an easy fit. When the rod, key and ear are in the position shown in FIG. 2, it is impossible for the rod to pull out of the socket. The key 25 engages the inner face of the outer wall 28 of the parti-cylindrical housing 29 which is formed at the inner end of the shell. The extreme inner end of this housing is closed by a snap-on disk 30, which fits the inner end of the housing precisely and prevents the cementitious material, in which the shell is embedded, from entering the cavity 26.

Figure 3:
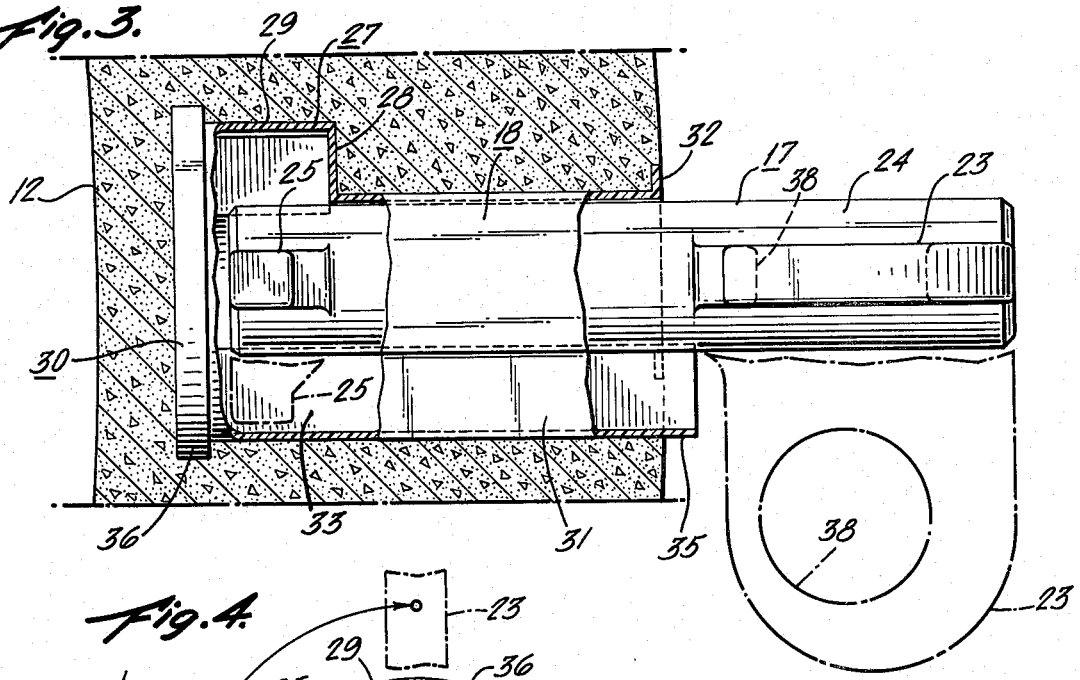
FIG. 3 is a plan view, in section, through the socket, showing the key and lifting rod in place.
Figure 4:
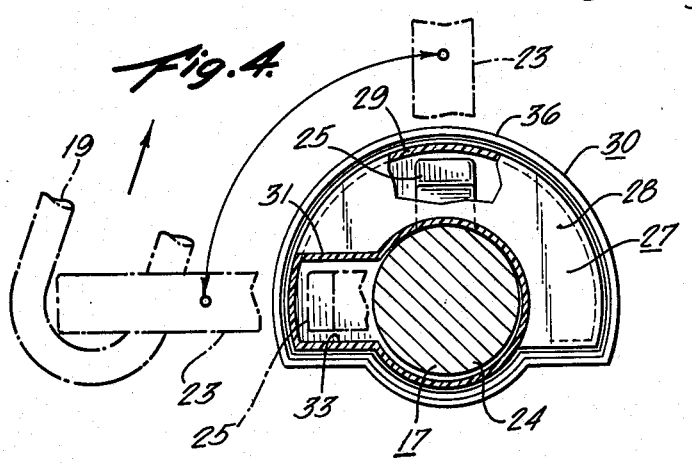
FIG. 4 is a detail taken on the line 4—4 of FIG. 2.

In order to provide a way for the key end of the rod 17 to be inserted into or removed from the socket 18, a longitudinal channel element or spline 31 is provided along one wall of the tubular portion of the shell. The wall of the tubular portion of the shell has a lengthwise slot-like opening into the open side of this three-sided channel or spline 31, as seen in FIGS. 3 and 4. The plan view (FIG. 3) also shows in elevation an end washer 32 which is molded integrally with the shell and abuts the outer end of the tubular portion of the shell and is adapted to rest against the inner face of the mold rings for forming the casting. The channel member extends through and beyond this washer, into a hole formed to receive it in the inner wall of the mold ring (not shown). This ensures that the shell will not rotate as the form is filled.

The housing 29 extends around at least the upper quarter of the periphery of the shell, to receive the key 25 and permit it to rotate through about 90°. Thus the key turns from the position in which it is inserted into the shell, with the ear 23 and the lug 25 in a horizontal plane, to the position shown in FIG. 2, where these parts lie in a vertical plane. An abutment surface is provided within the housing 29 by continuing the lower portion 33 of the channel 31 back to the inmost plane of that housing. The key 25 thus slides along the continuous surface 33 until it is all of the way into the cavity, is then rotated through 90° upwardly as lift is applied to the chain 19, and, after the casting is in place, slacking of the chain 19 permits the key 25 and the ear 23 to return to the horizontal plane, and thus to be removed, with the key 25 sliding lengthwise along and out of the spline 31.

After the casting has been cured and the shaping rings removed, grout may be applied between the outer surface of the casting and the end washer 32, preferably rounding the opening slightly to facilitate finding the mouth of the socket with the end of the rod 17.

One of the significant features of the present invention is the provision of a shell form which can be produced by injection molding. The known mold form previously referred to was itself produced by using a split mold and fusing the cast shell halves together. This provided a tubular sleeve having a closed end, but it involved a lengthwise seam, where the half-mold portions joined, on both walls of the tubular part. Such seams are sometimes rough, with projecting fins where the edges join. Furthermore, a substantial wall thickness was needed, so as to form a weld seam of sufficient strength. Furthermore, the key-like portion of the lifting pin for the known device was duplicated, like a fish tail, so that there was a key on both sides of the rod, and this necessitated use of a shell having opposed lateral channel elements on both sides of the tubular part, thus increasing the weakness adjacent the socket in the casting wall.

Still further, the lifting pin provided with this known device was headed like an eye-bolt, so that the lifting chain might or might not engage the rim of the eye in a position to exert maximum torque prior to lift. The known mold form just referred to also had opposed pockets formed in the tubular portion, into which the fish-tail keys were withdrawn when they had been rotated to a position exactly at 90° from the plane in which the channel members lay. "Finding" these pockets with the fish-tail keys was likely to be troublesome. Even though these requirements practically necessitated the use of a split mold casting, there seemed to be no other answer.

The shell which is made in accordance with the present invention does not require use of a split mold for its production. Instead, it is so designed that it can be formed by injection molding. It will be observed that the largest sectional dimension of the shell of the present invention is its innermost end. Consequently, the core can easily be inserted and withdrawn from this end. The necessity for completely sealing the inner end of the mold is met, in accordance with the present invention, by providing a peripheral flange 34 on the inner end of the housing 29, and providing a separate cover plate 30 with a peripheral flange 36 which is configured to make a snap fit over the flange 34, and snugly hold the cover plate against the end of the tubular portion. In this way, it is ensured that the inner surface of the mold will be free of roughness and feather edges, so as to facilitate insertion of the lifting pin into it.

Figure 6:
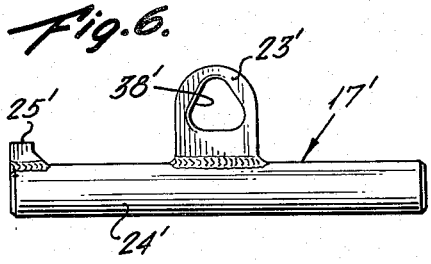
FIG. 6 shows a modified form of lifting rod.

It will be observed that the presence of the key 25 on the end of the rod 17 will prevent the lifting rod from entering a conventional drilled hole of commensurate diameter. In order not to limit the usefulness of the device, I prefer to extend the shaft or pin 24 outwardly beyond the lug or ear 23 for a distance approximately equivalent to the extent of this rod on the inner side of the lug 23. The outward end of the rod can thus be freely used if a casting is encountered which has merely drilled sockets, with no spline for the key. FIG. 6 illustrates this, using prime designations for the parts already described.

As a time saving method of installation of the shell in the casting, I prefer to fill the form for the casting to the desired level, using what is known as wet concrete — that is, a mix which comprises a larger proportion of water than is usually used for casting sewer pipe sections. The form for the casting is carefully leveled, and is then filled to the height at which the pockets 18 are to be positioned. The shells are then emplaced at this point, at the water level established by the mix already poured, with the projecting channel 35 inserted in a recess in the form. After this, the form for the casting is filled completely, and after the concrete has set, the form is removed and the casting may be lifted to the curing ovens by means of the assembly here described.

In order to be sure that the lifting chain 19 will rotate the pin to the position shown in FIG. 2 before any substantial lifting force is transmitted to the casting, it may be preferable to make the aperture 38' of pear shape (as shown in FIG. 6) rather than, as shown in FIG. 2, perfectly round.

The shells employed in carrying out this invention may be made of various materials, according to the skill of the makers of molded plastic articles. The shells thus far used were stated to have been molded from polypropylene, although the manufacturer suggests that polyvinyl chloride or polybutylene might be equally effective. The present invention is concerned with the devices, as such, regardless of what material is used for making them.

I claim:

1. A lifting asembly for use in handling massive concrete castings by means of a pair of lifting rods adapted to be inserted in transverse sockets in opposite walls of such casting, each of said assemblies comprising a rod with a single, laterally projecting key adjacent one end, and having a single ear spaced from the key and projecting from said rod in the same plane as the plane of the key, both of said rod and key members being configured to cooperate with a massive member of concrete having two transversely extending mutually aligned sockets therein, each defined by a shell of molded material embedded in said massive member, each of which shells comprises a tubular portion extending horizontally inwardly from an outer face of said massive member, each also having a single lateral channel part extending lengthwise along the outer periphery of the tubular portion of each shell and each channel part having its open side in communication, throughout its length, with the interior of said tubular portion; each of said tubular portions being dimensioned to loosely receive one of said rods and each of said channels being configured to pass one of said keys; the tubular portion of each shell terminating in a parti-cylindrical housing closed by a snap-fitted end plate and being concentric with the axis of the tubular portion and configured to accommodate angular movement of the said key on rotation of said rod, whereby to ensure that, after the rod has been inserted in the tubular portion of the shell, lifting stress applied to the ear will effect rotation of the rod until the key is so positioned as to be secure against withdrawal so long as tension on the cable is maintained.

2. A rod for use in the assembly defined in claim 1, wherein the projecting ear has an aperture which is broad adjacent the rod and tapers to an apex at the radially outward end.

3. A rod for use in the assembly recited in claim 1, wherein there is an extension of the rod outwardly from the projecting ear, which extension is not provided with a key.

4. A shell of molded material, as defined in claim 1, wherein the channel part extends longitudinally outward beyond the end of the tubular portion, and is adapted to position and retain the shell in fixed relation to a surrounding form.

5. A lifting assembly as defined in claim 1, wherein the casting is first formed, and is then drilled to provide sockets into which the shells are then inserted with grouting mix to fill the space between the tubular portion and the inner wall of the socket.

6. For use in a lifting assembly for moving massive concrete objects, an injection-molded shell to be embedded in such object, which shell comprises a cylindrical tubular portion terminating at one end in an annular flange and having at its opposite end a parti-cylindrical housing, with an externally-projecting peripheral flange about its open end and a cover plate having a contour congruent with said housing and having a peripheral flange with an inwardly-projecting lip to enter into snap-fitted relationship with the flange last mentioned, said tubular portion having a channel which extends axially and projects laterally outwardly from said tubular part and which provides a key-way from one end of said shell to the other, which channel part extends longitudinally beyond said terminal collar and is adapted to engage positioning openings in a surrounding form.

* * * * *